US008173922B2

(12) United States Patent
Chen

(10) Patent No.: US 8,173,922 B2
(45) Date of Patent: May 8, 2012

(54) THIN TYPE ILLUMINATED KEYBOARD

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 215 days.

(21) Appl. No.: 12/718,656

(22) Filed: Mar. 5, 2010

(65) Prior Publication Data

US 2011/0147182 A1 Jun. 23, 2011

(30) Foreign Application Priority Data

Dec. 18, 2009 (TW) ..... 98143538 A

(51) Int. Cl.
*H01H 9/00* (2006.01)

(52) U.S. Cl. ..... 200/314

(58) Field of Classification Search ..... 200/310–314, 200/5 A, 512, 517, 344–345; 362/555, 558, 362/559, 616, 26, 27
See application file for complete search history.

(56) References Cited

U.S. PATENT DOCUMENTS

| | | | | |
|---|---|---|---|---|
| 6,036,326 | A * | 3/2000 | Yoshikawa et al. | 362/23 |
| 7,847,204 | B2 * | 12/2010 | Tsai | 200/314 |
| 2001/0040802 | A1 * | 11/2001 | Shipman | 362/227 |
| 2006/0283698 | A1 * | 12/2006 | Huang et al. | 200/310 |

* cited by examiner

*Primary Examiner* — Edwin A. Leon
(74) *Attorney, Agent, or Firm* — Kirton McConkie; Evan R. Witt

(57) ABSTRACT

A thin type illuminated keyboard includes a light source, a light-guiding frame plate, a keycap, a membrane plate, a switch circuit plate and a base plate. The light source is used for emitting light. The light-guiding frame plate has a concave structure in a bottom surface thereof. The keycap is connected with the light-guiding frame plate and movable upwardly or downwardly with respect to the light-guiding frame plate. The keycap has a light-transmissible character portion. The light source is disposed on the membrane plate and accommodated within the concave structure of the light-guiding frame plate. The keycap, the light-guiding frame plate, the membrane plate, the switch circuit plate and the base plate are sequentially arranged from top to bottom. The light emitted by the light source is guided by the light-guiding frame plate to irradiate the light-transmissible character portion.

14 Claims, 3 Drawing Sheets

THIN TYPE ILLUMINATED KEYBOARD

FIELD OF THE INVENTION

The present invention relates to an illuminated keyboard, and more particularly to a thin type illuminated keyboard.

BACKGROUND OF THE INVENTION

A conventional computer keyboard has no self-illuminating function. Generally, a dim environment becomes hindrance from operating the keyboard. Recently, an illuminated keyboard has been developed. When the illuminated keyboard is used in the dim environment, the user can accurately depress desired keys by means of the light scattered from peripheries of the keys or middle portions of the keys. In addition, the light produced by the illuminated keyboard results in an aesthetically pleasing appearance. For example, Chinese Patent Application No. CN200820125924.4 disclosed an illuminated keyboard. The illuminated keyboard sequentially comprises a keycap, a connecting member, a light-transmissible base plate, a light-guiding plate, a light emitting diode, and a reflector. The keycap and the light-transmissible base plate are connected with each other through the connecting member. As such, the keycap is movable with respect to the light-transmissible base plate in the vertical direction. The light emitting diode is disposed on the reflector, and accommodated within a receptacle of the light-guiding plate. Through the reflector and the light-guiding plate, the light emitted by the light emitting diode is guided to the region under the keycap so as the illuminate the whole illuminated keyboard.

Since the conventional illuminated keyboard needs an additional light-guiding plate and associated keyboard component to guide light, the thickness of the illuminated keyboard increased and the illuminated keyboard is not cost-effective.

SUMMARY OF THE INVENTION

It is an object of the present invention to provide a thin type illuminated keyboard with reduced thickness and fabricating cost.

In accordance with an aspect of the present invention, there is provided a thin type illuminated keyboard. The thin type illuminated keyboard includes a light source, a light-guiding frame plate, a keycap, a membrane plate, switch circuit plate and a base plate. The light source is used for emitting light. The light-guiding frame plate has a concave structure in a bottom surface thereof. The keycap is connected with the light-guiding frame plate and movable upwardly or downwardly with respect to the light-guiding frame plate. The keycap has a light-transmissible character portion. The light source is disposed on the membrane plate and accommodated within the concave structure of the light-guiding frame plate. The keycap, the light-guiding frame plate, the membrane plate, the switch circuit plate and the base plate are sequentially arranged from top to bottom. The light emitted by the light source is guided by the light-guiding frame plate to irradiate the light-transmissible character portion.

In an embodiment, a scattering portion is formed on an inner wall of the concave structure at a side close to the keycap.

In an embodiment, the scattering portion includes plural scattering and refracting angles, which are formed on a periphery of the concave structure at the side close to the keycap.

In an embodiment, the light-guiding frame plate is arranged immediately under the keycap, and has an optical refraction profile. The optical refraction profile is formed by a texturing process or an optical etching process.

In an embodiment, the membrane plate is light-transmissible.

In an embodiment, the thin type illuminated keyboard includes a connecting member for connecting the keycap with the light-guiding frame plate.

In an embodiment, the light source is a light emitting diode.

In an embodiment, the light source is fixed on the membrane plate via an electrically-conductive adhesive.

In an embodiment, the base plate is a metallic plate.

In an embodiment, the base plate is an aluminum plate.

In an embodiment, the base plate is an iron plate.

In an embodiment, the thin type illuminated keyboard further comprises an elastic member, and the light-guiding frame plate has a hollow portion. The elastic member is penetrated through the hollow portion, so that the keycap is elastically movable upwardly and downwardly.

In an embodiment, the elastic member is made of silicone rubber.

In an embodiment, a bottom surface of the elastic member is disposed on the switch circuit plate and penetrated through a hollow portion of the light-guiding frame plate.

In an embodiment, after a surface of the keycap is processed by a paint-spraying process, a character is removed by a laser engraving process so as to define the light-transmissible character portion.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a thin type illuminated keyboard. The present invention will now be described more specifically with reference to the following drawings and embodiments. The thin type illuminated keyboard of the present invention is applied to an input device of an electronic apparatus such as a laptop, a desktop computer or an industrial computer.

Figure 1:
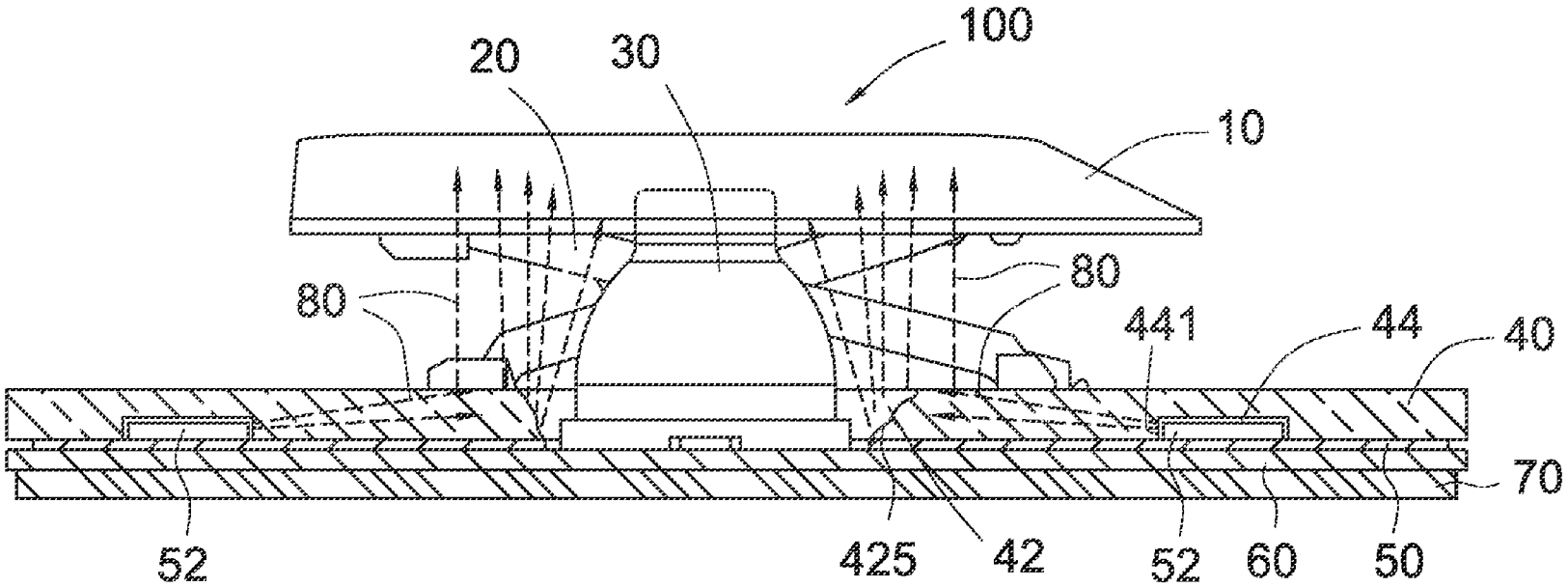
FIG. 1 is a schematic cross-sectional view illustrating a key structure of a thin type illuminated keyboard according to an embodiment of the present invention.
Figure 2:
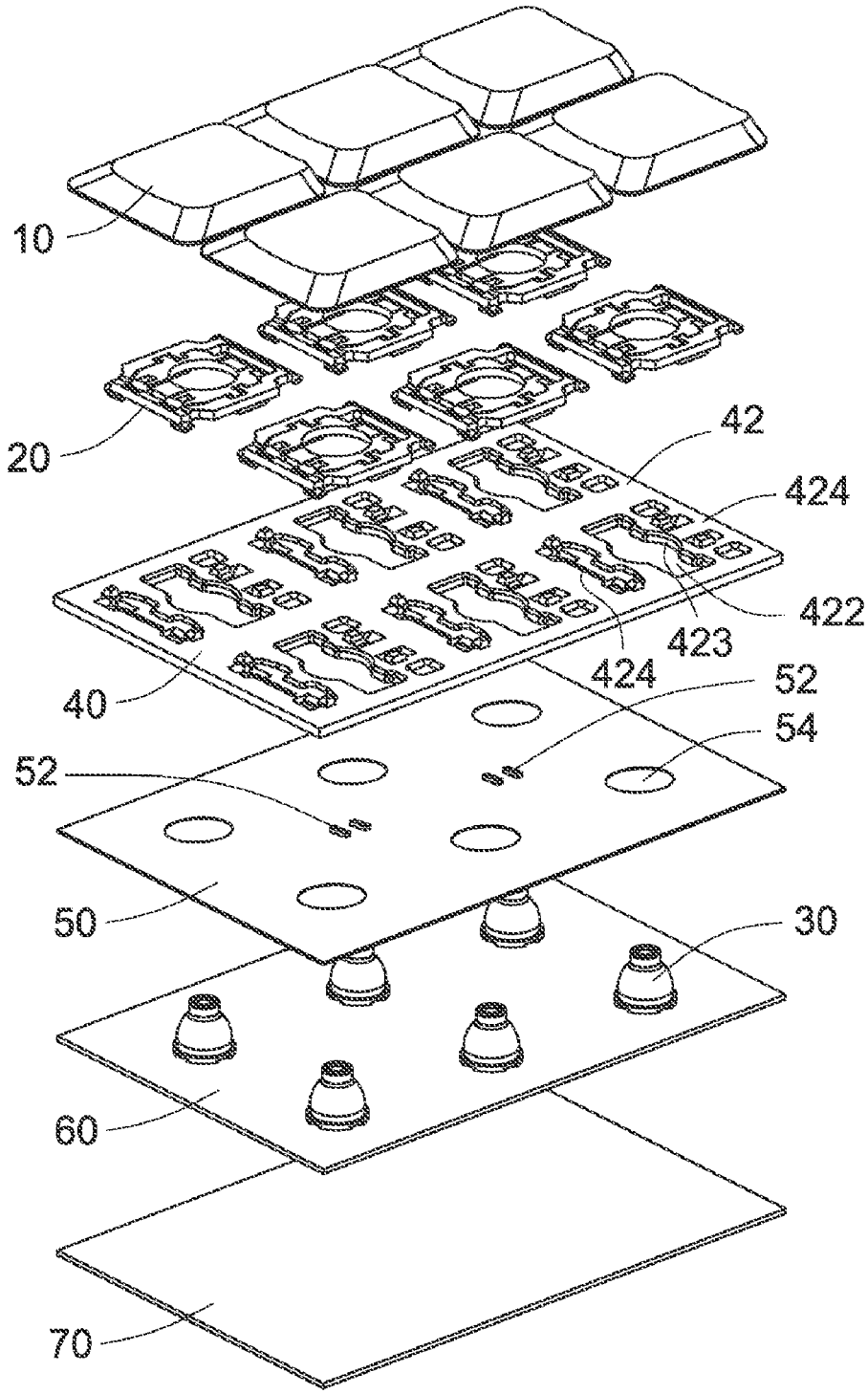
FIG. 2 is a schematic exploded view illustrating plural key structures of the thin type illuminated keyboard according to an embodiment of the present invention.
Figure 3:
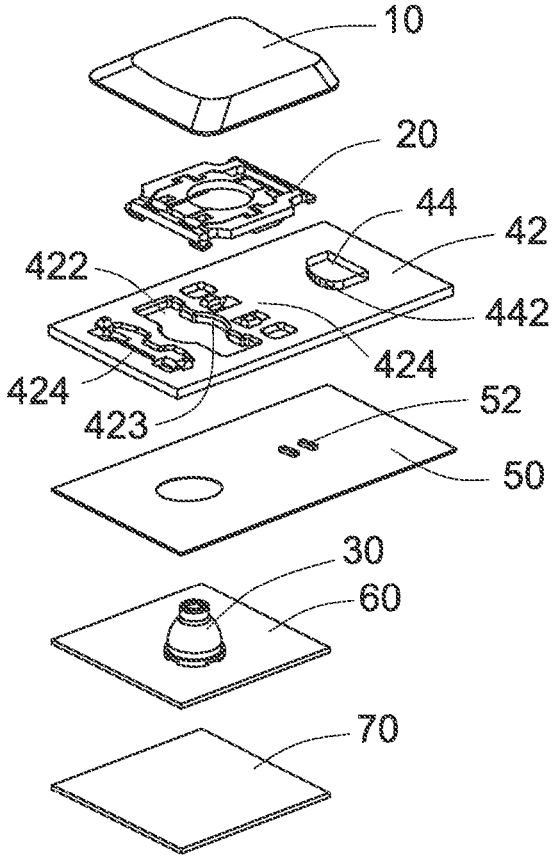
FIG. 3 is a schematic exploded view illustrating a single key structure of a thin type illuminated keyboard according to an embodiment of the present invention.

FIG. 1 is a schematic cross-sectional view diagram illustrating a key structure of a thin type illuminated keyboard according to an embodiment of the present invention. FIG. 2 is a schematic exploded view diagram illustrating plural key structures of the thin type illuminated keyboard according to an embodiment of the present invention. FIG. 3 is a schematic exploded view diagram illustrating a single key structure of a thin type illuminated keyboard according to an embodiment of the present invention.

Please refer to FIGS. 1, 2 and 3. A key structure of the thin type illuminated keyboard 100 of the present invention comprises a keycap 10, a connecting member 20, an elastic member 30, a light-guiding frame plate 40, a membrane plate 50 with plural light sources 52, a switch circuit plate 60 and a base plate 70. The keycap 10, the light-guiding frame plate 40, the membrane plate 50, the switch circuit plate 60 and the base plate 70 are arranged from top to bottom.

Figure 4:
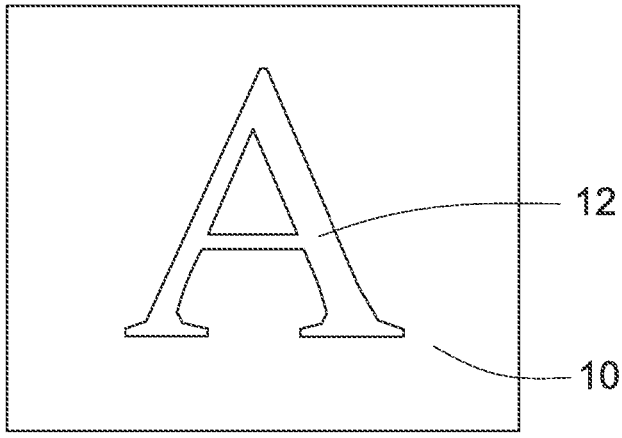
FIG. 4 is a schematic top view illustrating a light-transmissible character portion of the keycap of a thin type illuminated keyboard according to an embodiment of the present invention.

As shown in FIG. 4, the keycap 10 has a light-transmissible character portion 12 on a top thereof. In an embodiment, after the surface of the keycap 10 is processed by for example a paint-spraying process, the character is removed by for example a laser engraving process in order to define the light-transmissible character portion 12.

Alternatively, after the surface of the keycap 10 is processed by for example a paint-spraying process, the character portion is directly hollowed out to define the light-transmissible character portion 12, wherein the non-character portion of the keycap 10 is processed by a paint-spraying process or other means such that the non-character portion becomes opaque. As a consequence, the general character or symbol may be printed on the character portion 12.

The connecting member 20 is a scissors-type connecting structure for connecting the keycap 10 with the light-guiding frame plate 40. As such, the keycap 10 is movable with respect to the light-guiding frame plate 40 in the direction perpendicular to the surface of the illuminated keyboard 100. The elastic member 30 is made of silicone rubber and has a shape of an inverted cup. The upper end surface of the elastic member 30 is positioned on the bottom surface of the keycap 10. After the keycap 10 is penetrated through the light-guiding frame plate 40 and the membrane plate 50, the lower end surface of the keycap 10 is bonded onto the switch circuit plate 60. Alternatively, the lower end surface of the keycap 10 is not bonded onto the switch circuit plate 60, but in contact with the switch circuit plate 60. Due to the elastic member 30, the keycap 10 is elastically movable upwardly and downwardly.

Please refer to FIGS. 1, 2 and 3 again. The light-guiding frame plate 40 is made of plastic material and has a light-guiding function. Depending on the number and positions of the keycaps 10, the light-guiding frame plate 40 is divided into plural frame units 42. The frame units 42 have respective hollow portions 422, and the elastic members 30 of plural key structures are allowed to penetrate through respective hollow portions 422. Each frame unit 42 has two lateral connecting parts 424, which are arranged at bilateral sides of the hollow portion 422 and connected with the connecting member 20. Especially, an optical refraction profile 425 is formed on the inner wall 423 of the hollow portion 422 of each frame unit 42 by a texturing process or an optical etching process. For example, the optical refraction profile 425 formed on the inner wall 423 of the hollow portion 422 includes a curvy profile or a scraggy profile. By the optical refraction profile 425, the direction of the light 80 emitted by the light source 52 is changed, so that the light 80 is directed to the region immediately under the keycap 10. In addition, a concave structure 44 is formed in the bottom surface of the light-guiding frame plate 40 for accommodating the light source 52. A scattering portion is formed on the inner wall 441 of the concave structure 44 at the side close to the keycap 10. The scattering portion may facilitate scattering the light 80. In this embodiment, the cross-section of the bottom surface of the concave structure 44 is the longitudinal direction of the light-guiding frame plate 40 is substantially square. The scattering portion comprises plural scattering and refracting angles 442, which are formed on the periphery of the square bottom surface at the side close to the keycap 10 (i.e. on the periphery of the concave structure 44 at the side close to the keycap 10). In some embodiments, the scattering portion includes any other scraggy profile formed on the inner wall 441 of the concave structure 44 for facilitating scattering the light 80.

In an embodiment, the light source 52 is a light emitting diode. The driving circuit (not shown) for driving the light source 52 is disposed on the membrane plate 50. The light source 52 is fixed on the membrane plate 50 via an electrically-conductive adhesive, and accommodated within the concave structure 44 of the light-guiding frame plate 40. An exemplary membrane plate 50 is a transparent plastic sheet. Depending on the number and positions of the keycaps 10, the membrane plate 50 has respective hole 54. As such, the elastic members 30 of plural key structures could be penetrated through respective hole 54.

In an embodiment, the base plate 70 is a metallic plate such as an aluminum plate or an iron plate.

When the light source 52 is driven by the driving circuit to illuminate, the light 80 emitted by the light source 52 is guided to the region under the keycap 10 through the light-guiding frame plate 40. Then, by the optical refraction profile 425 that is formed on the inner wall 423 of the hollow portion 422 of each frame unit 42, the direction of the light 80 is changed, so that the light 80 is directed to the region immediately under the keycap 10 to irradiate the light-transmissible character portion 12 of the keycap 10.

The light source 52 and the driving circuit thereof are formed on the membrane plate 50. By using the original light-guiding frame plate to guide the light, the function of illuminating the illuminated keyboard is achieved without any other additional light-guiding plate or additional light-guiding element. Since no additional component is required, the fabricating cost is reduced. Moreover, since the light source 52 is arranged between the light-guiding frame plate 40 and the membrane plate 50 and buried within the light-guiding frame plate 40, the thickness of the light source 52 is sunk into the thickness of the light-guiding frame plate 40. In other words, the overall thickness of the illuminated keyboard is not increased while maintaining a minimized thickness.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A thin type illuminated keyboard comprising:

a light source for emitting light;

a light-guiding frame plate having a concave structure in a bottom surface thereof;

a keycap connected with said light-guiding frame plate, and movable upwardly or downwardly with respect to said light-guiding frame plate, wherein said keycap has a light-transmissible character portion;

a membrane plate, wherein said light source is disposed on said membrane plate and accommodated within said concave structure of said light-guiding frame plate;

a switch circuit plate; and a base plate, wherein said keycap, said light-guiding frame plate, said membrane plate, said switch circuit plate and said base plate are sequentially arranged from top to bottom, and said light emitted by said light source is guided by said light-guiding frame plate to irradiate said light-transmissible character portion, and wherein a scattering portion is formed on an inner wall of said concave structure at a side close to said keycap.

2. The thin type illuminated keyboard according to claim 1 wherein said scattering portion comprises plural scattering and refracting angles, which are formed on a periphery of said concave structure at said side close to said keycap.

3. The thin type illuminated keyboard according to claim 1 wherein said membrane plate is light-transmissible.

4. The thin type illuminated keyboard according to claim 1 further comprising a connecting member for connecting said keycap with said light-guiding frame plate.

5. The thin type illuminated keyboard according to claim 1 wherein said light source is a light emitting diode.

6. The thin type illuminated keyboard according to claim 5 wherein said light source is fixed on said membrane plate via an electrically-conductive adhesive.

7. The thin type illuminated keyboard according to claim 1 wherein said base plate is a metallic plate.

8. The thin type illuminated keyboard according to claim 7 wherein said base plate is an aluminum plate.

9. The thin type illuminated keyboard according to claim 7 wherein said base plate is an iron plate.

10. The thin type illuminated keyboard according to claim 1 wherein after a surface of said keycap is processed by a paint-spraying process, a character is removed by a laser engraving process so as to define said light-transmissible character portion.

11. A thin type illuminated keyboard comprising:

a light source for emitting light;

a light-guiding frame plate having a concave structure in a bottom surface thereof;

a keycap connected with said light-guiding frame plate, and movable upwardly or downwardly with respect to said light-guiding frame plate, wherein said keycap has a light-transmissible character portion;

a membrane plate, wherein said light source is disposed on said membrane plate and accommodated within said concave structure of said light-guiding frame plate;

a switch circuit plate; and a base plate, wherein said keycap, said light-guiding frame plate, said membrane plate, said switch circuit plate and said base plate are sequentially arranged from top to bottom, and said light emitted by said light source is guided by said light-guiding frame plate to irradiate said light-transmissible character portion, and wherein said light-guiding frame plate is arranged immediately under said keycap, and has an optical refraction profile, which is formed by a texturing process or an optical etching process.

12. A thin type illuminated keyboard comprising: a light source for emitting light; a light-guiding frame plate having a concave structure in a bottom surface thereof; a keycap connected with said light-guiding frame plate, and movable upwardly or downwardly with respect to said light-guiding frame plate, wherein said keycap has a light-transmissible character portion; a membrane plate, wherein said light source is disposed on said membrane plate and accommodated within said concave structure of said light-guiding frame plate; a switch circuit plate; and a base plate, wherein said keycap, said light-guiding frame plate, said membrane plate, said switch circuit plate and said base plate are sequentially arranged from top to bottom, and said light emitted by said light source is guided by said light-guiding frame plate to irradiate said light-transmissible character portion, and wherein said thin type illuminated keyboard further comprises an elastic member, and said light-guiding frame plate has a hollow portion, wherein said elastic member is penetrated through said hollow portion, so that said keycap is elastically movable upwardly and downwardly.

13. The thin type illuminated keyboard according to claim 12 wherein said elastic member is made of silicone rubber.

14. The thin type illuminated keyboard according to claim 12 wherein said bottom surface of said elastic member is disposed on said switch circuit plate.

* * * * *